US006712309B1

(12) United States Patent
Martinez

(10) Patent No.: US 6,712,309 B1
(45) Date of Patent: Mar. 30, 2004

(54) METHOD AND MEANS FOR PACKAGING DRAPERIES FOR PURPOSES OF STORAGE OR TRANSPORTATION

(75) Inventor: Michael Martinez, Montclair, CA (US)

(73) Assignee: Ernest Paper Products Inc., Commerce, CA (US)

( * ) Notice: Subject to any disclaimer, the term of this patent is extended or adjusted under 35 U.S.C. 154(b) by 0 days.

(21) Appl. No.: 09/693,260

(22) Filed: Oct. 20, 2000

(51) Int. Cl.[7] ..... B65H 75/06; B65H 75/28

(52) U.S. Cl. ..... 242/537; 242/613.1

(58) Field of Search ..... 242/160.1, 170, 242/176, 177, 222, 437, 437.1, 437.3, 437.4, 472.5, 472.7, 532, 532.1, 532.5, 532.6, 579, 585, 587.2, 610, 610.1, 610.2, 610.3, 613.2, 613, 613.1, DIG. 2; 206/812, 819, 820, 395, 396

(56) References Cited

U.S. PATENT DOCUMENTS

| | | | | | |
|---|---|---|---|---|---|
| 811,899 | A | * | 2/1906 | Billstein | 242/607.1 |
| 889,512 | A | * | 6/1908 | Delaney | 242/610.2 |
| 1,192,594 | A | | 7/1916 | Woodruff et al. | |
| 1,650,051 | A | | 11/1927 | Smith et al. | |
| 3,059,763 | A | * | 10/1962 | Eifrid | 206/400 |
| 3,327,844 | A | | 6/1967 | Karp et al. | |
| 3,412,847 | A | * | 11/1968 | Wise et al. | 206/52 |
| 3,661,341 | A | * | 5/1972 | Eifrid | 242/115 |
| 3,817,475 | A | * | 6/1974 | Goldstein | 242/115 |
| 3,876,073 | A | * | 4/1975 | Herbetko | 206/400 |
| 4,394,996 | A | | 7/1983 | Heimberg | |
| 5,509,620 | A | * | 4/1996 | Crews | 242/608 |
| 5,915,062 | A | * | 6/1999 | Jackson et al. | 385/137 |

* cited by examiner

*Primary Examiner*—Donald P. Walsh
*Assistant Examiner*—Mark J Beauchaine
(74) *Attorney, Agent, or Firm*—Jurgen Vollrath

(57) ABSTRACT

A method and system for packaging draperies includes the use of a packaging element. The packaging element has a central core having a C-shaped configuration which is sandwiched between two side panels. A drapery is wound around the core to define a drapery package which is packed into a carton with other drapery packages for shipping.

19 Claims, 3 Drawing Sheets

METHOD AND MEANS FOR PACKAGING DRAPERIES FOR PURPOSES OF STORAGE OR TRANSPORTATION

FIELD OF THE INVENTION

The invention relates to a method of packaging draperies for purposes of storage or transportation. It also relates to a packaging element for packaging draperies, and the resultant drapery package.

BACKGROUND OF INVENTION

Draperies are typically pleated at their upper ends, making it impossible to fold them flat for purposes of storage or transportation. Another way to accommodate them, therefore, had to be devised. In the past, they were commonly hung on low-grade wire hangers and shipped in wardrobe cartons, using a combination of materials and methods. The folding and packaging for shipment or storage, however, results in the draperies frequently getting creased or wrinkled. Attempts have been made to overcome these difficulties. Some prior art approaches involve wrapping the pleated or fan-folded fabric around a flat, corrugated cardboard core. The problem with such a system is that the fabric receives distinct fold lines when wrapped onto such a two-dimensional core.

U.S. Pat. No. 4,394,996 attempts to improve on this problem by showing a drapery package comprising a three dimensional core member that essentially has a C-shaped profile defining. The 996 patent requires that the drapery first be longitudinally folded, and then its lower end inserted into a U-shaped gap defined by the core member. The resultant drapery packages are placed into cartons and shipped. Not only does the need for folding the drapery require significant amounts of labor, the drapery is also prone to creasing by virtue of the fact that the packages abut one another.

SUMMARY OF INVENTION

According to the invention, there is provided a packaging element for packaging fabric, comprising a core and a pair of side panels sandwiching the core between them, wherein the core defines a substantially C-shaped structure.

Preferably, the core has a U-shaped end and a V-shaped end and is made by folding a planar material into the core's C-shaped configuration. The core may be secured to the side panels by means of tabs formed integrally with the rest of the core to extend from the core. The tabs are passed through complimentary slots in the side panels. Preferably, the side panels include incisions or other means for securing at least one free end of the fabric. Instead of such means on the side panels, or in addition thereto, the drapery may be secured relative to the core by means of separate securing means such as elastic bands or shrink wrap.

In a preferred embodiment, the drapery is mechanically wound onto the packaging element. For this purpose the side panels may include facilities for securing the packaging element to a winder for winding the fabric onto the core. For instance, the side panels may have holes for receiving pins that can be attached to a winding motor.

Further, according to the invention there is provided a drapery package comprising a packaging element and a drapery wound around the packaging element.

Still further, according to the invention, there is provided a method of packaging a drapery comprising the steps of providing a packaging element that includes a C-shaped core sandwiched between two side panels, inserting a portion of the drapery into the C-shaped core, and winding the drapery around the core.

Preferably, the pleats at the upper end of the drapery are pushed together and inserted into the core. In an embodiment where the core has a U-shaped end, the pleats are preferably inserted into the U-shaped end. Typically, the drapery is wound around the core by rotating the packaging element.

DETAILED DESCRIPTION OF THE INVENTION

Figure 1:
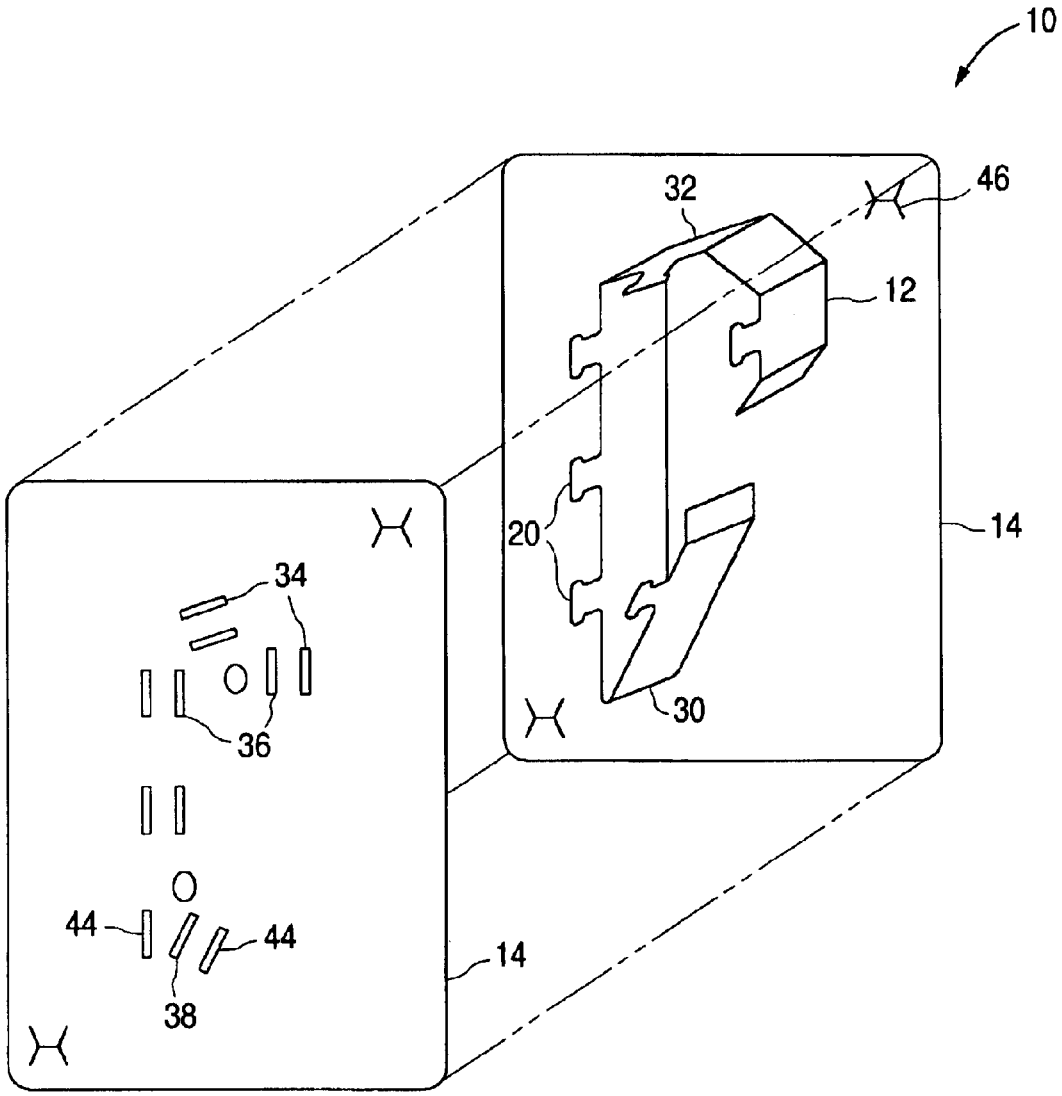
FIG. 1 is a three dimensional partially exploded view of one embodiment of a packaging element in accordance with the invention.

The packaging element of the present invention is intended to address some of the shortcomings of drapery packaging systems known in the art today. FIG. 1 shows a packaging element of the invention. The element 10 includes a central core or core element 12 which is sandwiched between two side panels 14.

Figure 2:
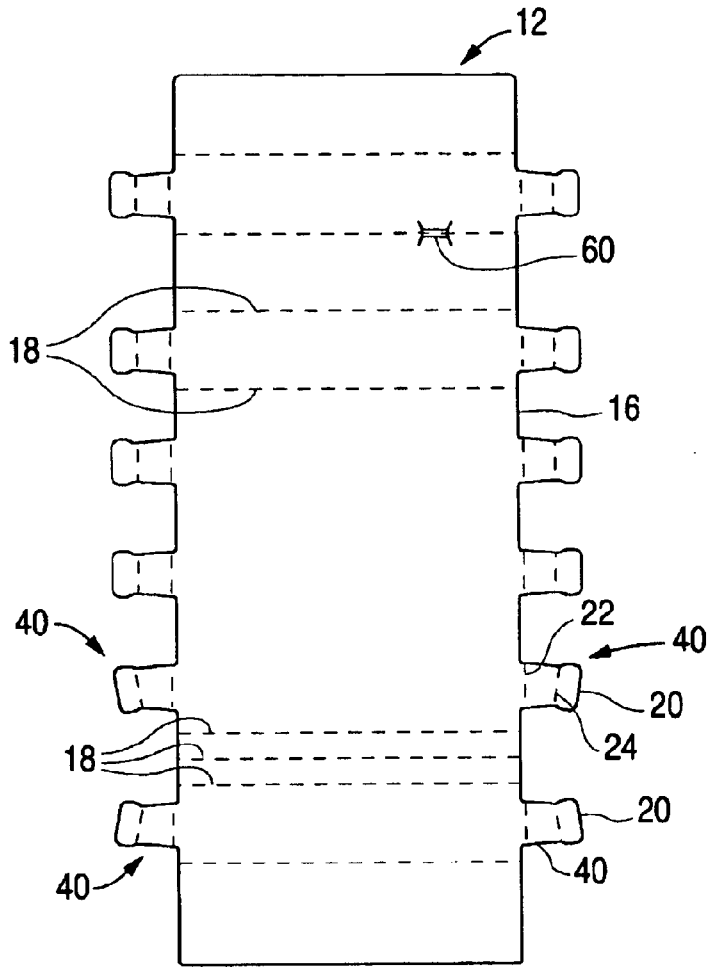
FIG. 2 is a plan view of one embodiment of a core element in a flat, unfolded state.

The core element 12 is shown in an unfolded, flat configuration in FIG. 2. The core element 12 is made of a planar material such as corrugated cardboard, or suitable plastics or laminates. The core element 12 includes a central body 16 which has a number of crease lines 18, and may, in fact, be scored along the crease lines 18. Tabs 20 extend from either side of the body 16. Each tab 20 includes two crease lines 22, 24. The tabs 20 may be scored along the crease lines 22, 24. The crease lines/score lines 18 define how the core element 12 is folded to achieve the C-shaped configuration illustrated in FIGS. 1 and 3. In its folded state, the core element 12 includes a V-shaped end 30, and a U-shaped end 32.

Figure 3:
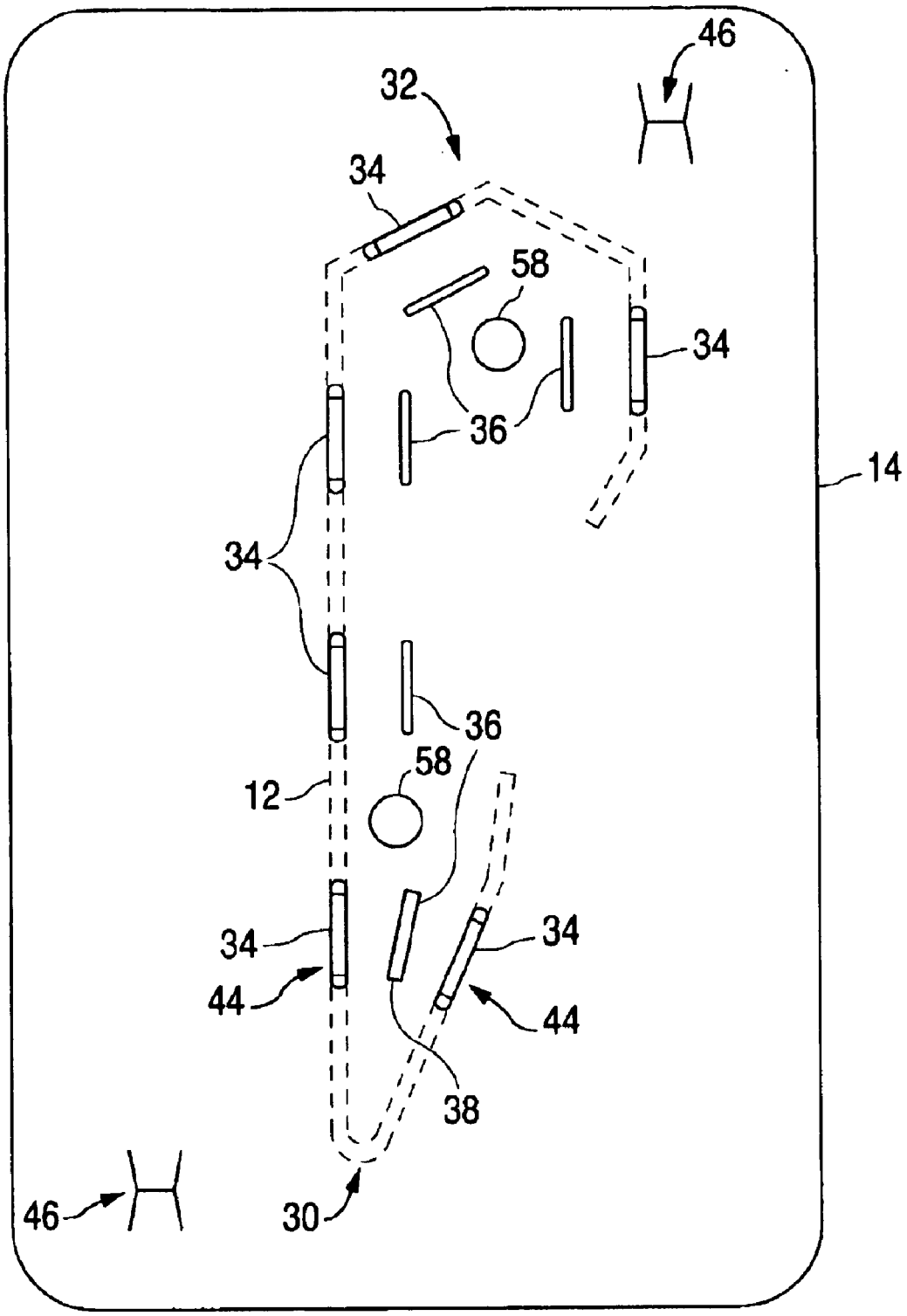
FIG. 3 is a plan view of one embodiment of a side panel forming part of the packaging element of the invention showing the positioning of the core element in broken lines.

As illustrated in FIG. 3, the side panels 14 define a series of slots 34 for receiving the tabs 20 of the core element 12. Each of the tabs 20 is inserted into a slot 34 and bent at 90° along crease line 22 to lie flush with the outer surface of its side panel 14. Each tab 20 is also bent along crease line 24 at a 90° angle to allow the free end of the tab 20 to be fed back, into the slots 36. It will be appreciated that the one slot, which is depicted by reference numeral 38, is somewhat wider to accommodate the free ends of the two tabs lying on either side of it, depicted by reference numerals 40 in FIG. 2. As can be seen on FIG. 2, the crease lines 24 of the tabs 40, are somewhat angled relative to the longitudinal axis of the body 16 in order to accommodate the relative angles between the slot 38 and its two adjacent slots, which are depicted by reference numerals 44.

The tabs 20, thus serve to secure the two side panels 14 to the core element 12, thereby sandwiching the core element 12 between them. It will be appreciated that the side panels could be secured to the core element by other means that need not necessarily be formed integrally with the body of the core, such as clips, lengths of wire, adhesive, etc.

FIG. 3 also shows two H-shaped incisions 46 formed in the side panels 14. The incisions 46 serve to secure the free end of a drapery once the drapery is wrapped around the core element 12. Typically the drapery is protected by a plastic sheath or bag that forms a protective covering and extends beyond the upper and lower ends of the drapery. The portion of the sheath that extends beyond the free end of the drapery, once the drapery is wound onto the core, is inserted into one of the H-shaped incision 46 where it is captured and held in place. Either one of the two H-shaped incisions 46 can be used for this purpose depending on which of the incisions 46 is closest to the free end of the drapery.

Figure 4:
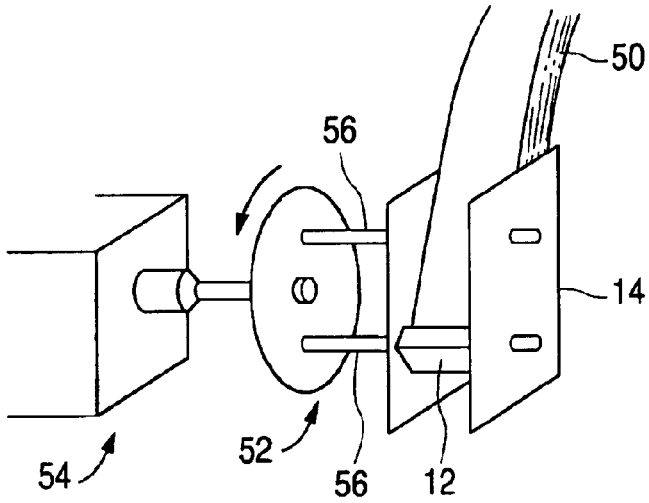
FIG. 4 is part of one embodiment of a system showing the formation of drapery packages using the packaging element of the invention.

FIG. 4 illustrates the process of forming a drapery package by winding a drapery 50 around the core element 12 of the packaging element 10. In this embodiment, an automatic winding apparatus is used to wind the drapery onto the core element 12. The automatic winding apparatus includes a jig 52 secured to a motor 54 that serves to rotate the jig 52. The jig 52 includes two pins 56 that pass through complimentary holes 58 in the side panels 14. The draperies 50 that are wound up on to the packaging element 10 are typically pleated. Thus it is easy to push the pleats together so as to abut each other. The upper pleated portion of the drapery is then typically inserted into the U-shaped end 32 of the core element 12, whereafter the rest of the drapery 50 is wound around the core element 12. As discussed above, typically the drapery is protected by a plastic sheath or bag (not shown) that forms a protective covering and extends beyond the upper and lower ends of the drapery. The portion of the sheath extending beyond the upper pleated portion of the drapery is inserted into the incision 60 in the core element 12 (FIG. 2), thereby securing an initial portion (in this case, the pleated upper portion) of the drapery 50 relative to the core. It will be appreciated that any other portion of the drapery 50 could equally well be inserted into the U-shaped end 32 and the rest of the drapery 50 wound around the core element 12. As explained above, the free end or ends of the drapery 50, once the rest of the drapery has been wound around the core element 12, is/are secured by inserting the protective sheath into one or both of the H-shaped incisions 46 in either one of the side panels 14.

The resultant drapery package, comprising the drapery 50, with its protective sheath, wound onto the packaging element 10, is then removed from the jig 52 and placed into a carton. Typically a number of drapery packages, for example, 5, are packed into a carton and the carton sealed for shipping.

Instead of inserting the free end or ends of the drapery into the H-shaped incisions 46, or in addition thereto, the drapery may be secured relative to the packaging element 10 by an elastic band, stretched wrap, or other suitable means.

It will be appreciated that the side panels 14 serve not only to space a drapery 50 from the inner surface of the carton to further reduce wrinkling of the drapery 50, it also helps to avoid the drapery resting on the floor once it is removed from the carton. Furthermore, the side panels 14 help to retain the drapery between them, thereby avoiding the drapery slipping off the core element 12.

It will be appreciated that the specific configuration of the embodiment illustrated in the FIGS. 1 through 4 is given purely by way of illustration and does not in any way limit the scope of the invention. Other embodiments for receiving and protecting a drapery can be used without departing from the spirit of the invention.

What is claimed is:

1. A packaging element for packaging fabric, comprising a core, and a pair of side panels sandwiching the core between them, wherein the core defines a substantially C-shaped structure.

2. A packaging element of claim 1, wherein the C-shaped core has a U-shaped end and a V-shaped end.

3. A packaging element of claim 2, wherein the core element is secured to the side panels by means of tabs extending from the core and passing through complimentary slots in the side panels.

4. A packaging element of claim 1, wherein the core element is made of a planar material that is folded into the core's C-shaped configuration.

5. A packaging element of claim 4, wherein the side panels include incisions for receiving at least one free end of the fabric.

6. A packaging element of claim 1, wherein the side panels include facilities for securing the packaging element to a winder for winding the fabric onto the core.

7. A drapery package comprising a packaging element, and a drapery wound around the packaging element, wherein the packaging element includes a C-shaped core and a pair of side panels sandwiching the core between them.

8. A drapery package of claim 7, wherein the C-shaped core has a U-shaped end and a V-shaped end.

9. A drapery package of claim 8, wherein a portion of the drapery is inserted into the U-shaped end and the rest of the drapery is wound around the core.

10. A drapery package of claim 7, wherein a portion of the drapery is inserted into the C-shaped core and the rest of the drapery is wound around the core.

11. A drapery package of claim 7, wherein the side panels include facilities for securing the packaging element to a winder for winding the fabric onto the core.

12. A drapery package of claim 7, wherein the side panels include incisions for receiving at least one free end of the drapery.

13. A drapery package of claim 7, further comprising securing means for securing the drapery relative to the core element.

14. A method of packaging a drapery comprising the steps of providing a packaging element that includes a C-shaped core sandwiched between two side panels, inserting a portion of the drapery into the C-shaped core, and winding the drapery around the core.

15. A method of claim 14 wherein the C-shaped core has two legs, the one legs defining a U-shaped end, and the other leg defining a V-shaped end.

16. A method of claim 15, wherein the step of inserting the drapery into the C-shaped core includes pushing together pleats at the upper end of the drapery and inserting the pleats into the U-shaped end.

17. A method of claim 15, wherein the drapery is wound around the core by rotating the packaging element.

18. A method of claim 14, wherein the drapery is wound around the core by rotating the packaging element.

19. A method of claim 14, further comprising placing at least one of the packaging elements with the drapery wound around it into a carton.

* * * * *